US005813196A

United States Patent [19]

Pagé et al.

[11] Patent Number: 5,813,196

[45] Date of Patent: Sep. 29, 1998

[54] AUTOMATIC SEQUENTIAL BAGGING MACHINE WITH CONSTANT FEED AND METHOD OF OPERATION

[75] Inventors: Serge Pagé , Pointe-du-Lac; Guy Champagne, Boucherville; Dave Roberts, Bowmanville; John Edwards, Montreal, all of Canada

[73] Assignee: Glopak, Inc., Montreal, Canada

[21] Appl. No.: 586,031

[22] Filed: Jan. 16, 1996

[51] Int. Cl.[6] ..... B65B 35/30

[52] U.S. Cl. ..... 53/448; 53/449; 53/459; 53/469; 53/473; 53/498; 53/499; 53/171; 53/284.7; 53/247; 53/571; 53/539

[58] Field of Search ..... 53/443, 448, 449, 53/473, 459, 469, 570, 571, 247, 248, 495, 498, 499, 500, 539, 542, 171, 284.7

[56] References Cited

U.S. PATENT DOCUMENTS

| | | | |
|---|---|---|---|
| 3,698,153 | 10/1972 | Lieberman | 53/495 |
| 4,052,837 | 10/1977 | Saintonge | 53/499 |
| 4,124,967 | 11/1978 | Beer et al. | 53/499 X |
| 5,117,614 | 6/1992 | Johnsen | 53/171 X |
| 5,267,426 | 12/1993 | Davis | 53/171 X |
| 5,461,846 | 10/1995 | Cormier et al. | 53/469 X |

*Primary Examiner*—Daniel Moon
*Attorney, Agent, or Firm*—Swabey Ogilvy Renault; Guy I. Houle

[57] ABSTRACT

A method and a machine for automatically bagging articles in a bag and in a sequential and uninterrupted manner. A plurality of articles are continuously fed to the machine and received in two or three compartments, herein three compartments. Once the third article is received in the third compartment, all three articles are discharged within a bag held under the machine. A control circuit, after a predetermined time delay actuates an article support element which is caused to enter into the third compartment or the first compartment depending on the sequence of loading the machine whereby to support a fourth article entering the third compartment due to the fact that the bottom end of all compartments is open. The feeding device is uninterrupted and continues to feed articles to the machine regardless if the bottom discharge gate is open and the sequence is automatically reversed, back and forth, between the first and third and third and first compartments.

16 Claims, 8 Drawing Sheets

AUTOMATIC SEQUENTIAL BAGGING MACHINE WITH CONSTANT FEED AND METHOD OF OPERATION

TECHNICAL FIELD

The present invention relates to a method and an apparatus for automatically bagging articles, such as pouches into a bag and wherein the feed of such articles is uninterrupted with the machine being loaded sequentially from its first to its last compartment and then from its last to its first compartment. Preferably, but not exclusively, the automatic article bagging machine is for placing milk pouches into an outer bag.

BACKGROUND ART

The automatic article bagging machine of the present invention is of the type described in U.S. Pat. No. 3,698,153 issued on Oct. 17, 1972. However, a problem with the prior art machines is that after the compartment of the housing has been loaded with pouches it is necessary to reset the hinged gates to their initial position. This is a time consuming process which results in malfunction which causes jams when pouches inadvertently hit moving gates. The machine is also very noisy due to the fact that the gates have to be reset to their initial position at each loading cycle of the machine. Also, with such prior art machines, on occasion, the bag in which the pouches are released sometimes will not be held completely long enough when the load is discharged therein and again resulting in a machine stoppage. Therefore, it is necessary to have an operator continuously on standby.

SUMMARY OF INVENTION

It is therefore a feature of the present invention to provide a method and a machine for automatically bagging a predetermined number of articles into a bag and in a sequential and uninterrupted manner from an article feeding device carrying a plurality of spaced articles.

Another feature of the present invention is to provide a method and a machine for placing at least two articles in a bag in a sequential and uninterrupted manner from an article feeding device carrying a plurality of spaced articles and wherein an article support means is moved in a last one of compartments being loaded where a succeeding article is discharged immediately after the last article of the preceding group.

Another feature of the present invention is that the new sequence provides for a smoother operation with reduced noise and vibration. The new packing sequence reduces the number of strokes of the air cylinders controlling the hinged gates, thereby reducing wear and tear and maintenance costs and longer machine life.

According to the above features, from a broad aspect, the present invention provides an automatic article bagging machine for placing at least two articles in a bag from an article receiving housing having at least two compartments loaded in alternating sequence from an article feeding device carrying a plurality of spaced articles. The housing receives the articles therein in an uninterrupted manner. The housing has at least two compartments and a hinged gate to guide a first one of the articles from the article feeding device to a first one of the compartments. A further one of the articles is discharged in a further one of the compartments with the hinged gate moved to a non-obstructing open position with respect to the further one of the compartments. The housing has a discharge gate at a lower end thereof. Bag support means is provided for holding a bag under the compartments in a position to receive the at least two articles when the hinged gate is moved to a discharge open position. Detection means is provided to sense the presence of the first and second articles as they enter the first and further compartments. Control means is provided for receiving signals from the detection means. Article support means is displaceably movable in and out of a lower section of each of the compartments above the discharge gate and actuable by the control means to momentarily enter its associated compartment to support a succeeding article being discharged in a last loaded one of the compartments moments after the discharge gate is moved to the discharge position where the articles in the compartments are released from a bottom open end of the housing and with the hinged gate remaining in the non-obstructing open position to accept a first article of a next group of the at least two articles in the further one of the compartments.

According to a still further broad aspect of the present invention the housing is provided with three compartments, with a central compartment being located between opposed end compartments. There are two hinge gates to direct the first and the second article to a first and a central compartment, respectively. A third compartment receives a third article. The article support means are associated with the first and third compartments which are the opposed end compartments.

According to a further broad aspect of the present invention there is provided a method of automatically bagging at least two articles in a bag from an article receiving housing having at least two compartments loaded in alternating sequence from an article feeding device carrying a plurality of spaced articles. The method comprises the steps of feeding by means of a hinge gate a first one of the articles in a first compartment of an article holding housing. The first article entering the first compartment is detected and a first hinge gate is displaced in non-obstruction open position with respect to a further compartment to accept a second article in the further compartment. The second article entering the further compartment is also detected whereupon the articles are discharged from a bottom end of the compartment through a hinged gate to release the articles into an open bag. An article support means is actuated, a predetermined time after the hinge plate is actuated, and enters into the further compartment to obstruct an open bottom end of the further compartment to support a first article of the next group of articles being discharged in the further compartment while the hinged gate remains in the non-obstructing open position to accept the first article of the next group of two articles. Accordingly, the feed of articles to the compartments is uninterrupted.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
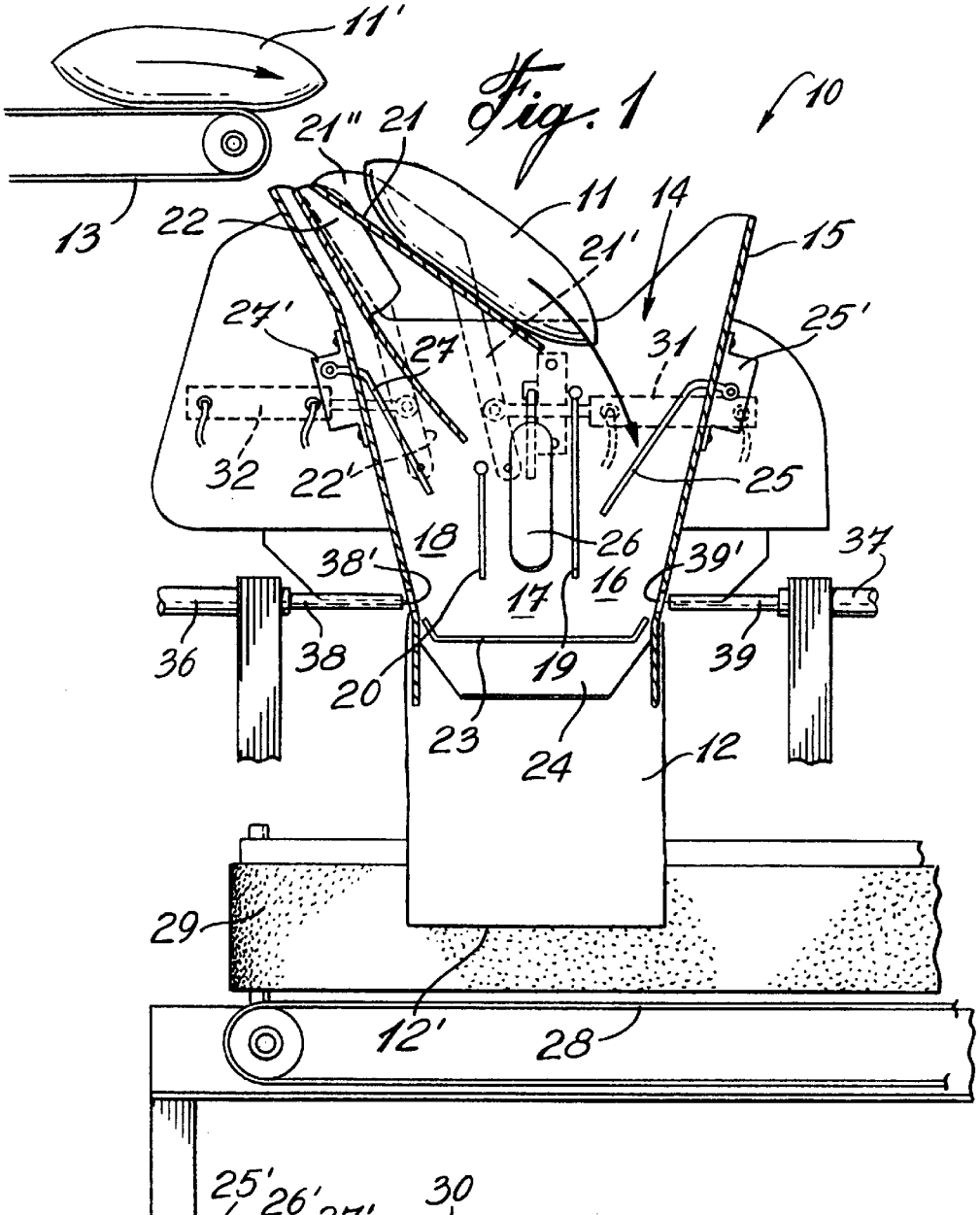
FIG. 1 is a simplified section view showing the automatic article bagging machine of the present invention receiving a first article, herein a pouch, in a first compartment thereof.

Referring now to the drawings and more particularly to FIG. 1, there is shown generally at 10 the automatic article bagging machine of the present invention for placing at least two, herein three, articles 11 in an outer bag 12. As herein-shown the articles 11 are spaced apart on a feed conveyor 13 and fed in an uninterrupted manner into the top end 14 of the article receiving housing 15. In this particular embodiment, the housing is provided with three compartments and namely a first compartment 16 at one end of the housing 15, a central compartment 17 and a third compartment 18 at the opposed end of the housing. The compartments are separated by partition wall sections 19 and 20.

Figure 2:
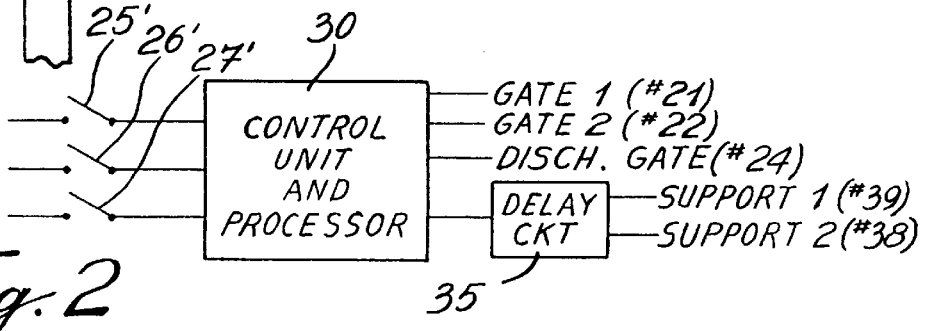
FIG. 2 is a simplified block diagram of the control unit.

As also shown in FIG. 1, there is provided two hinge gates namely gates 21 and 22 which are supported respectively on hinge arms 21' and 22', to displace the gates from a loading position to an unobstructing position, as will be described later. As also illustrated in this figure, the housing is provided with an open bottom end 23 and against which is secured a pivoting discharge gate 24 to release articles from within the three compartments into the outer bag 12 supported adjacent the open bottom end 23. Each compartment 16, 17 and 18 is also provided with a switch arm 25, 26 and 27 respectively and projecting therein in the path of the articles discharged therein, to detect the articles 11 entering their respective compartments. The switch arms are connected to an electric switch 25', 26' and 27' respectively to send a signal to the control unit 30, as illustrated in FIG. 2, whereby to advise the control unit that a pouch 11 has been placed within a certain compartment. A discharge conveyor assembly comprising a horizontal support conveyor 28 and a side guide conveyor 29 are located spaced closely below the bottom end 12' of the outer bag 12 whereby to convey a loaded bag away from the housing 15.

The control unit 30 is a programmable logic controller which allows the programming of the sequence and the length of time that the discharge gate 24 remains open. It is also pointed out that the electric switches 25 to 27 could be replaced by photoelectric cells or proximity switches.

Figure 3:
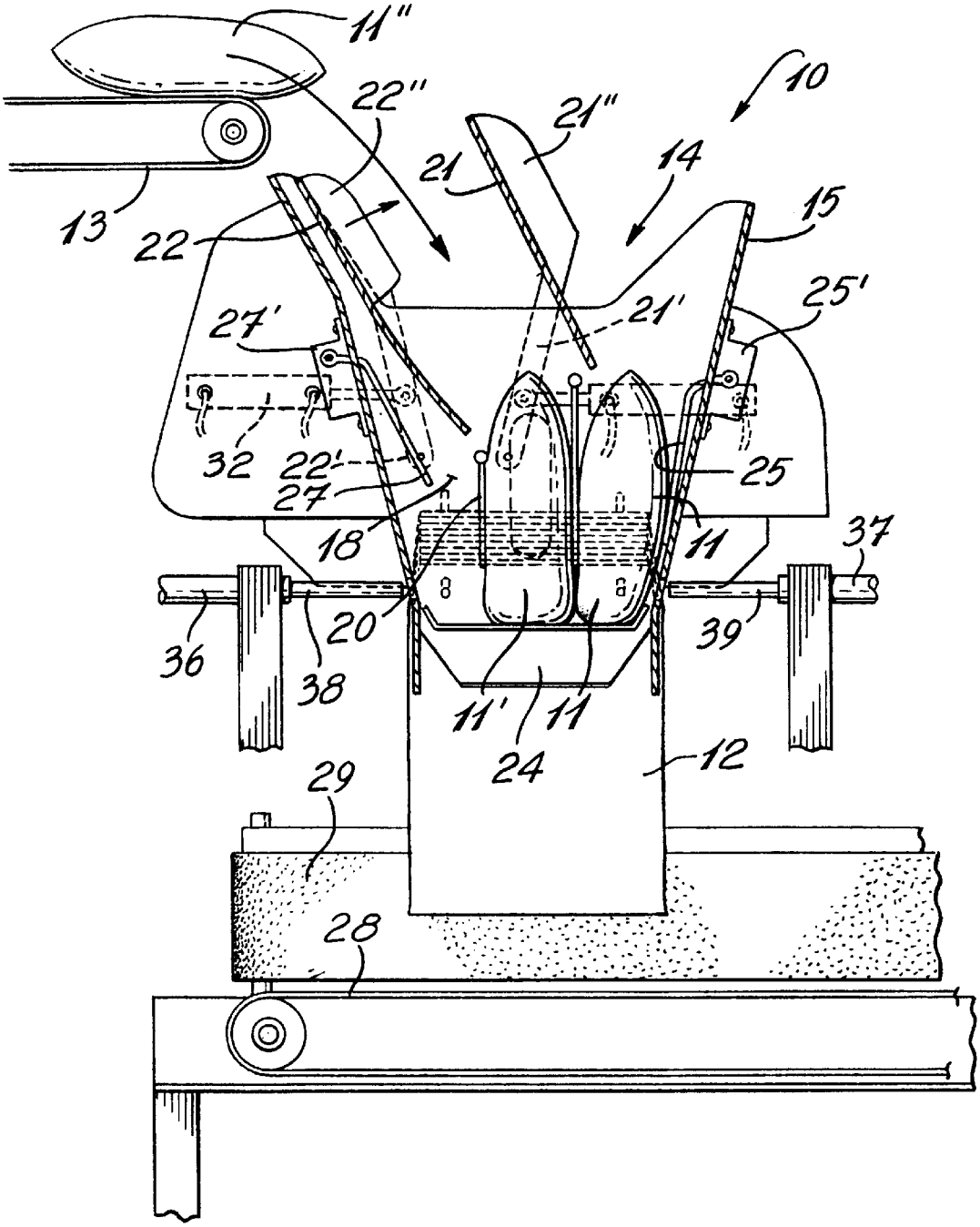
FIG. 3 is a simplified section view of the bagging machine, similar to FIG. 1, showing a second article being positioned within a second compartment.
Figure 4:
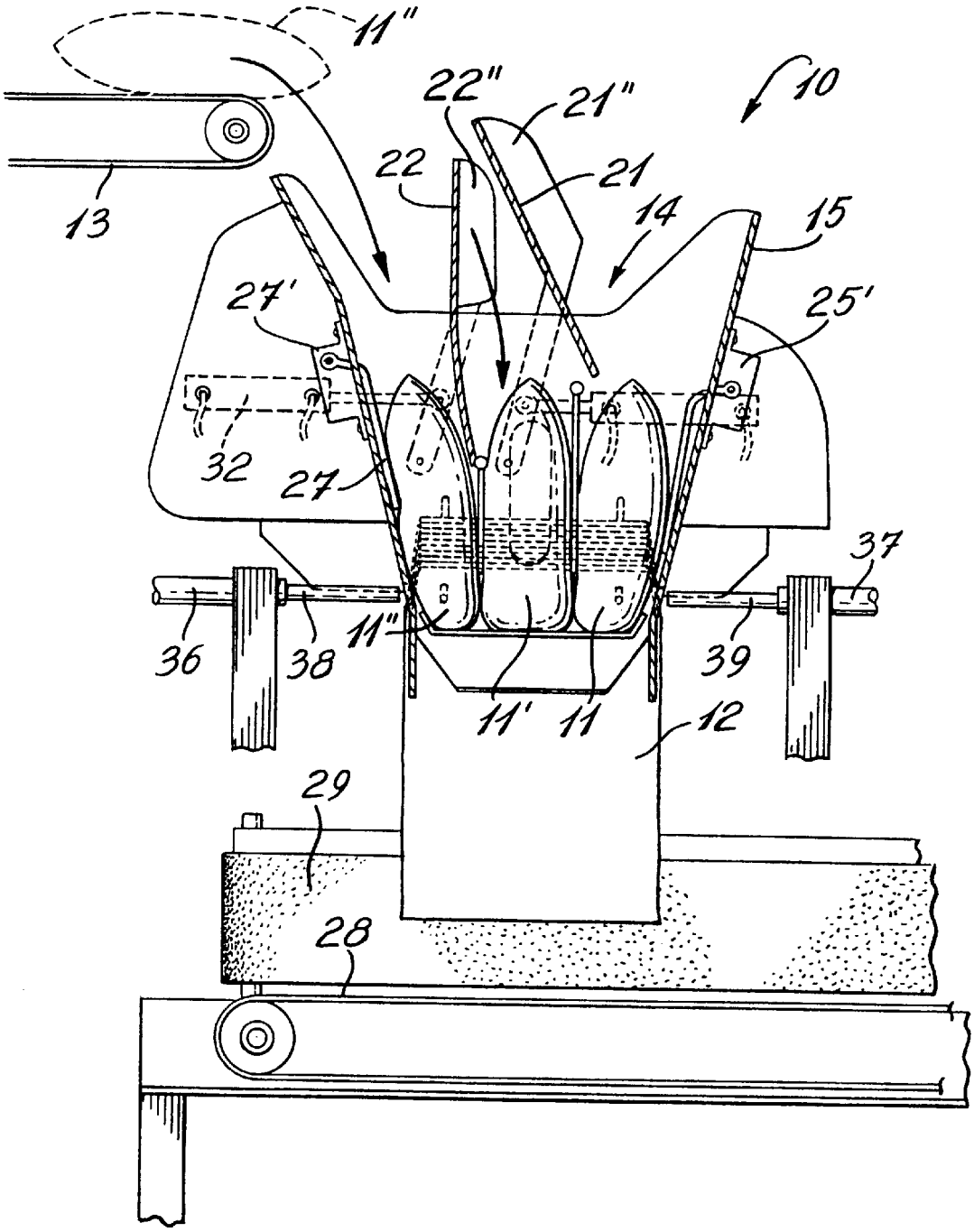
FIG. 4 is a view similar to FIG. 3 but showing a third article being loaded in a third compartment.

Referring now additionally to FIGS. 2 to 5 there will be described the manner in which three succeeding pouches 11, 11' and 11" are loaded within the housing 15. As shown in FIG. 1, as the first pouch 11 enters the first compartment 16 it will cause the switch arm 25 to pivot therefore causing a switch closure of its associated electric switch 25' sending a signal to the control unit that the first pouch is entering the first compartment 16. The control unit is provided with a computer having a processor circuit and upon receipt of this signal, or after a short predetermined time delay, will cause the cylinder 31 connected to the hinge arm 21' of the hinge gate 21 to pull the gate 21 to its unobstructing position, as shown in FIG. 3. A second compartment 17 is now unobstructed and the second pouch 11' has just been released onto the second hinge gate 22 which guides the second pouch into the central compartment 17. These gates 21 and 22 are provided with opposed side walls 21" and 22" to assure that the pouch is properly guided within the compartments. As the second pouch 11' enters the central compartment, it will actuate its associated switch arm 26 causing the electric switch 26' to close sending another signal to the control unit to cause the cylinder 32 associated with the second hinge arm 22' to displace the hinge gate 22 to its unobstructing position as shown in FIG. 4. The third pouch 11" is immediately released within the third end compartment 18 and upon which closing the switch arm 27 actuates the electric switch 27' and sends a further signal to the control unit 30.

Figure 5:
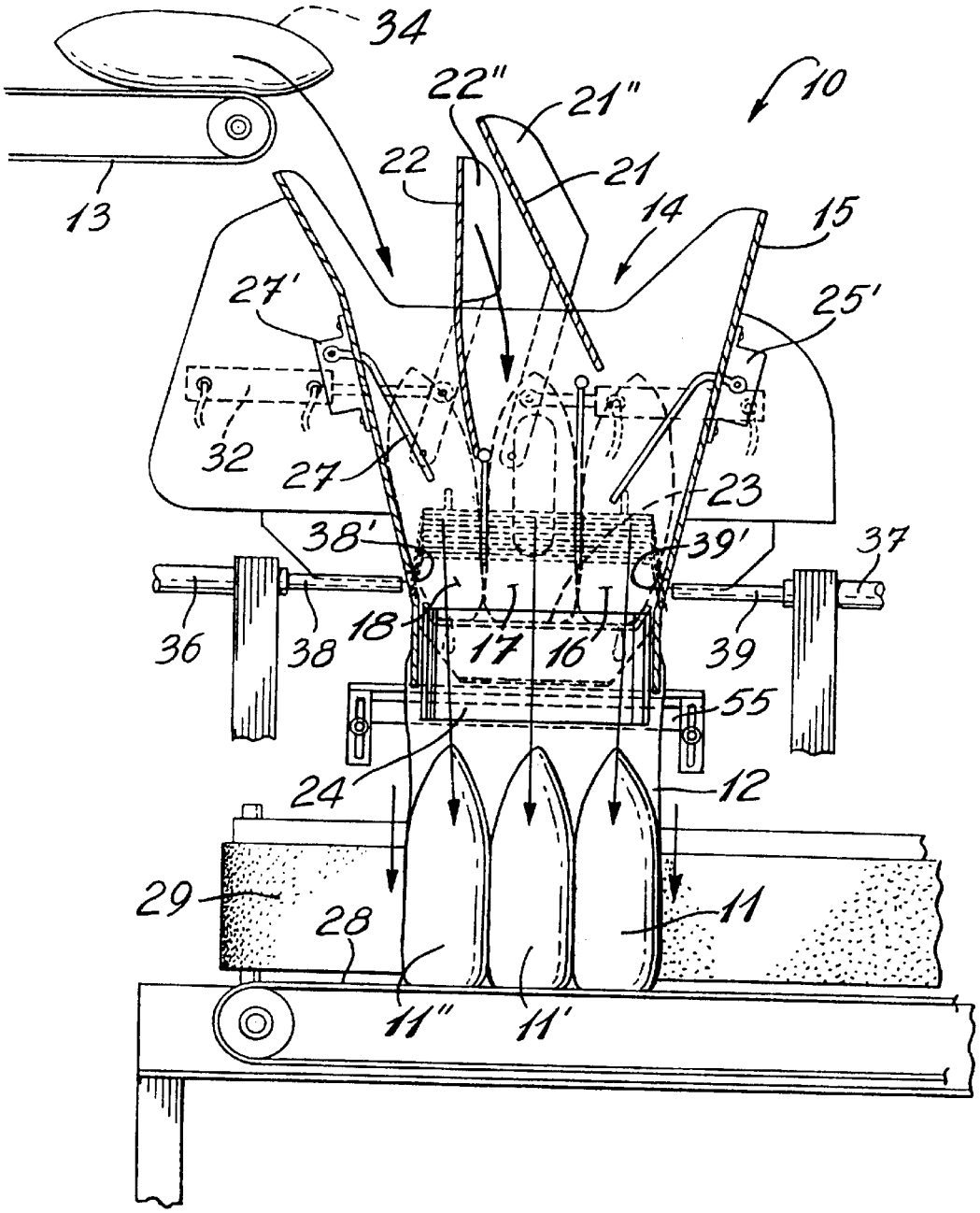
FIG. 5 is a view also similar to FIG. 3 and showing a fourth article being discharged in the third compartment and the three previous articles being discharged within a bag.

Upon receiving this third signal by the closure of switch 27', the control unit immediately actuates the pivotal discharge gate 24 which causes the open end of the bag 12 to be grasped, as will be described later. The three pouches 11, 11' and 11" are discharged within the outer bag 12 having its open end completely retracted, as shown in FIG. 5. At that moment, a fourth pouch 34 is being discharged within the third compartment 18. The control unit is provided with a delay circuit 35, as shown in FIG. 2, which has sensed the closure of switch 27' identifying that this was the last loaded compartment. The delay circuit, after a predetermined time delay, sends a signal to one of the cylinders 36 or 37 associated with an article support means, herein a finger element 38 and 39 respectively whereby to cause the finger support element to enter its respective compartment 18 or 16, through a port 38' and 39', respectively, and disposed above the bottom open end 23 of the compartments. This finger support element 39 obstructs the open end whereby to hold the next pouch being loaded in its associated compartment while the gate is open, as clearly illustrated in FIG. 8.

Figure 8:
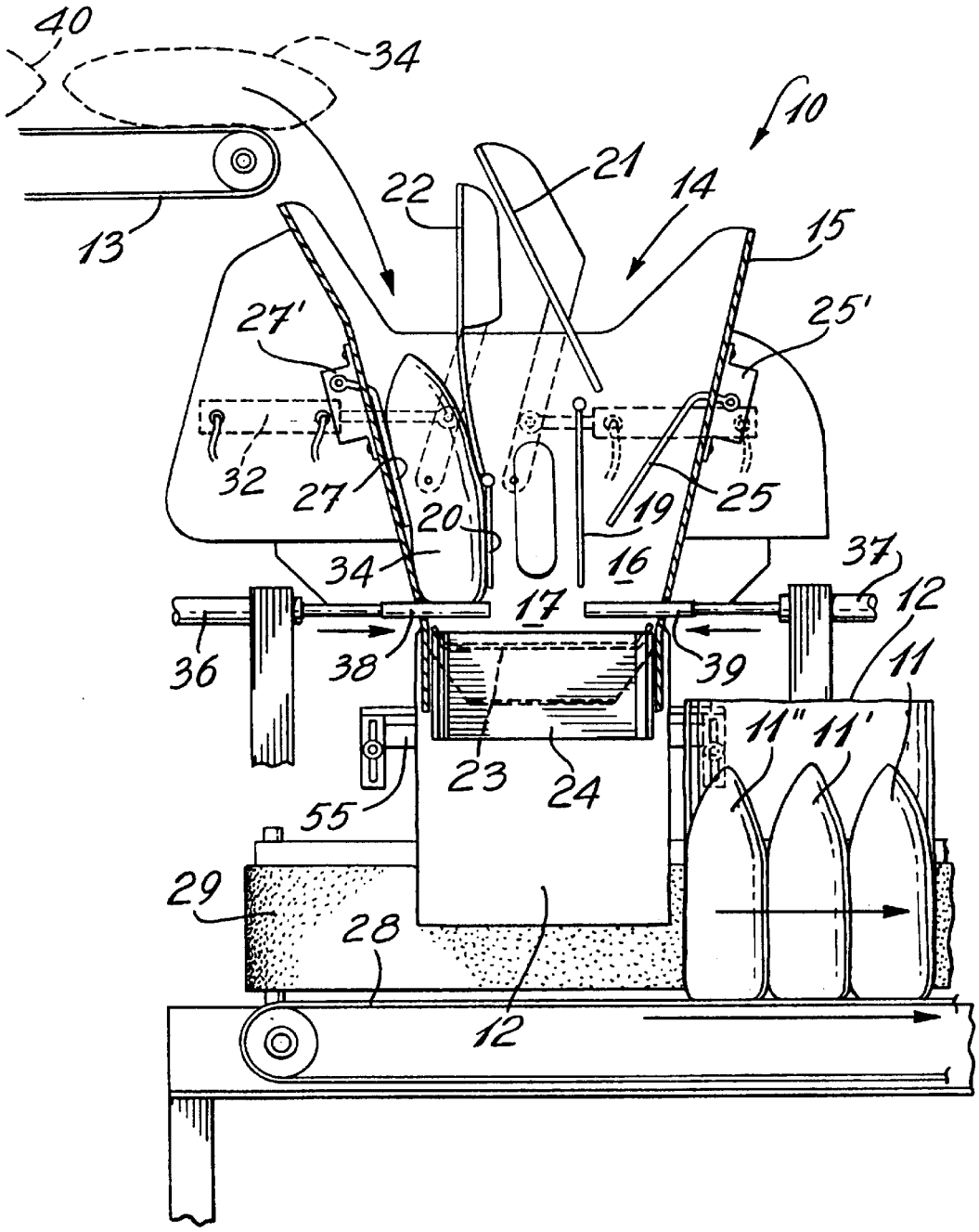
FIG. 8 is a view similar to FIG. 3 but showing the fourth article positioned within the third compartment while the discharge gate is still retracted.
Figure 9:
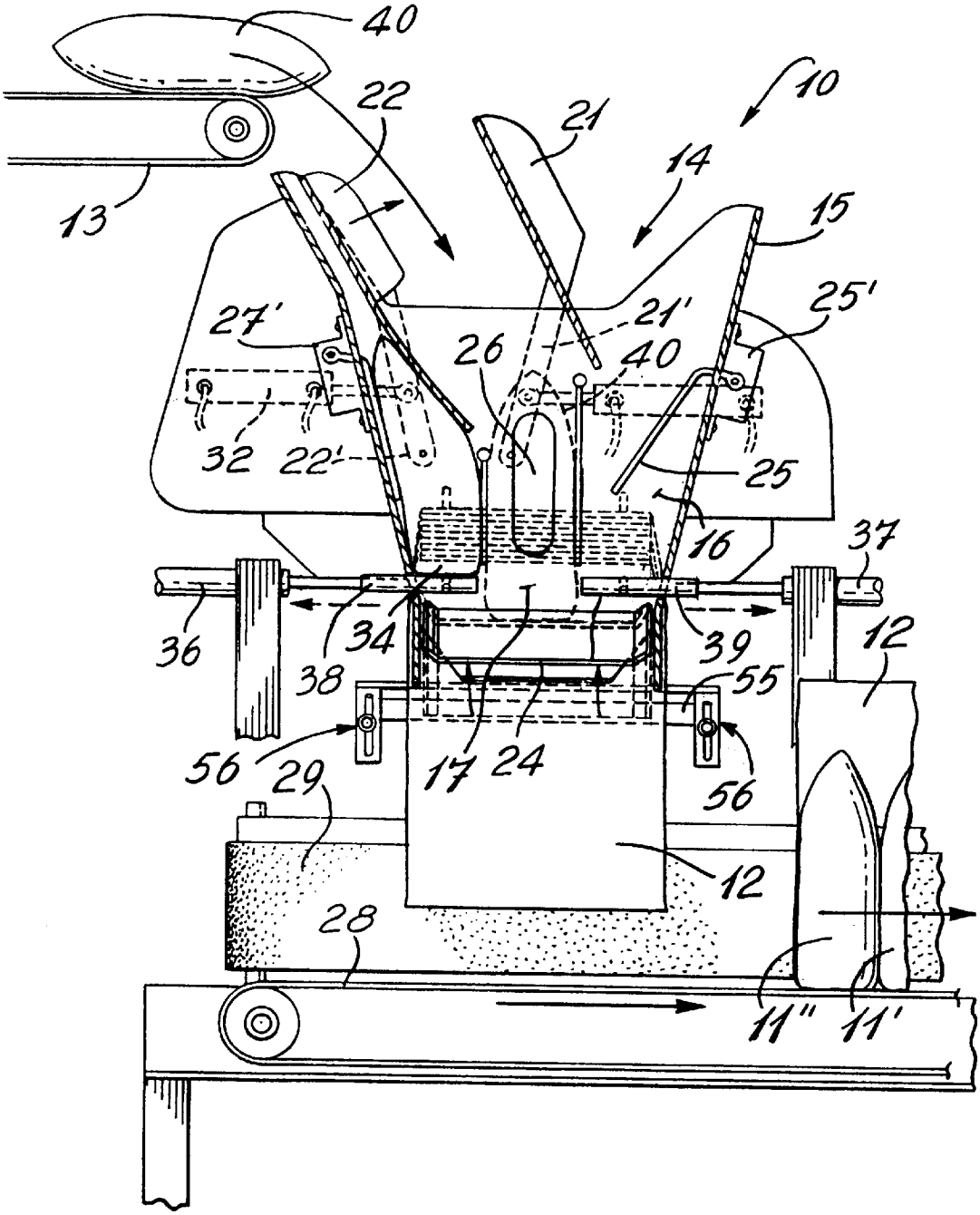
FIG. 9 is a view similar to FIG. 8 but showing the reversal of the sequence wherein a fifth article is being discharged into the second compartment and wherein one of the hinge gates has been displaced.

As shown in FIGS. 8 and 9, the fourth pouch 34 is thus placed in the third compartment 18 and supported by the finger support element 38 while the discharge gate 24 is still open. Immediately after its discharge the gate 24 is pulled back and releases the outer bag 12, as will be described later which bag is transported away on the horizontal discharge conveyor 28. Upon entry of the fourth pouch 34 within the third compartment, the switch arm 27 has again been actuated to send a signal to the control unit 30 advising it that it is now time to actuate the second hinge gate 22 from its initial unobstructing position to a guiding position as shown in FIG. 9. The fifth pouch 40 has now arrived and is ready to be discharged in the central compartment to its position as shown in FIG. 9 and with the pivotal discharge gate 24 having been completely retracted or being in the process of being retracted. The switch arm 26 is actuated by the fifth pouch 40 and sends a further signal to the control unit which displaces the hinge gate 21 to its initial position, as shown in FIG. 1, whereby to receive into the first compartment 16 a sixth pouch (not shown). A reverse cycle has now been completed and the machine now reverses its cycle again and reloads the compartments. Accordingly, it can be seen that the compartments are loaded sequentially and in an uninterrupted alternating manner whereby a constant feed of articles 11 is supplied from the feed conveyor 13 without interruption.

Figure 6:
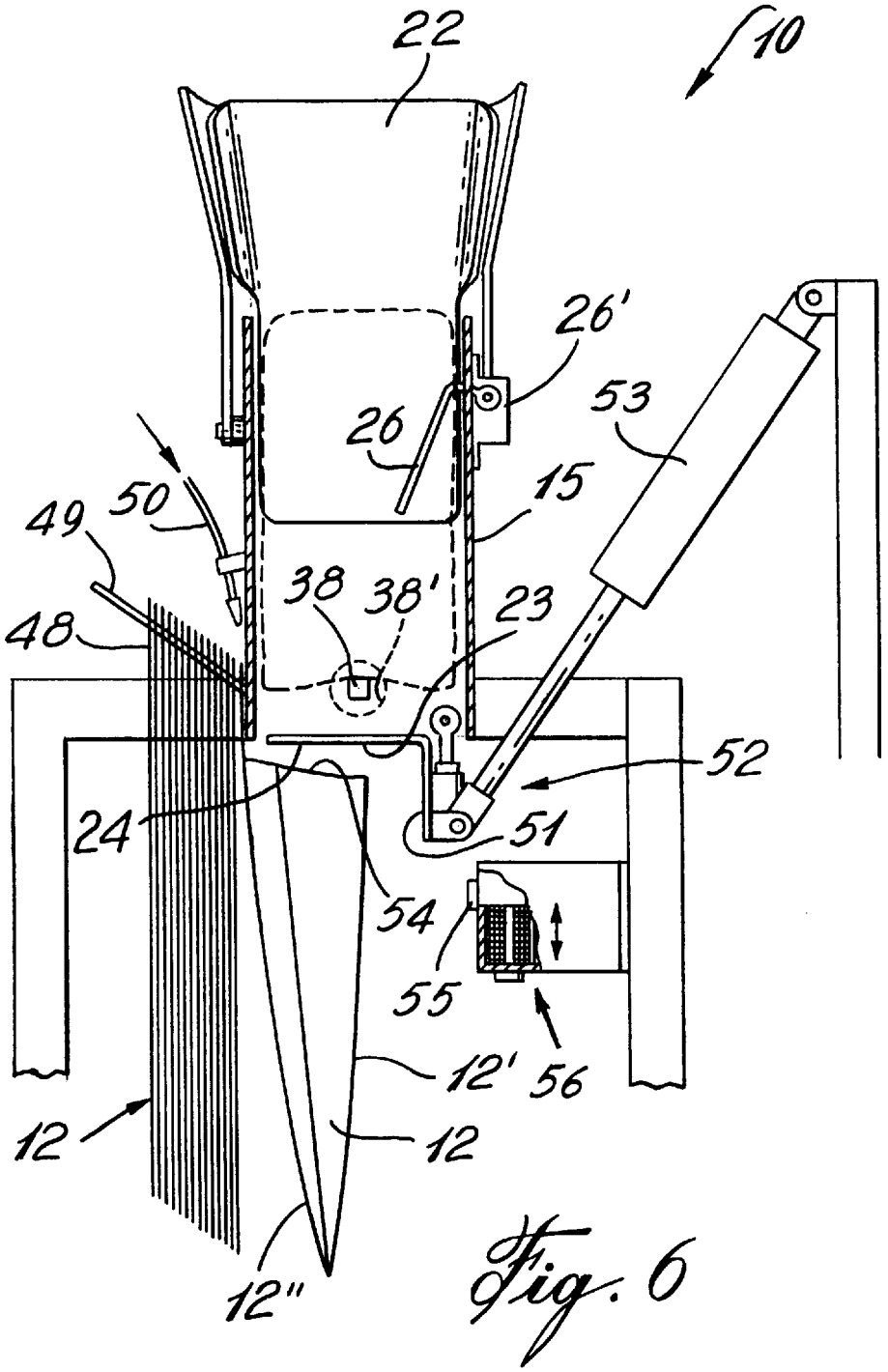
FIG. 6 is a side view of the article bagging machine showing the position of the bag under the bottom end of the machine.
Figure 7:
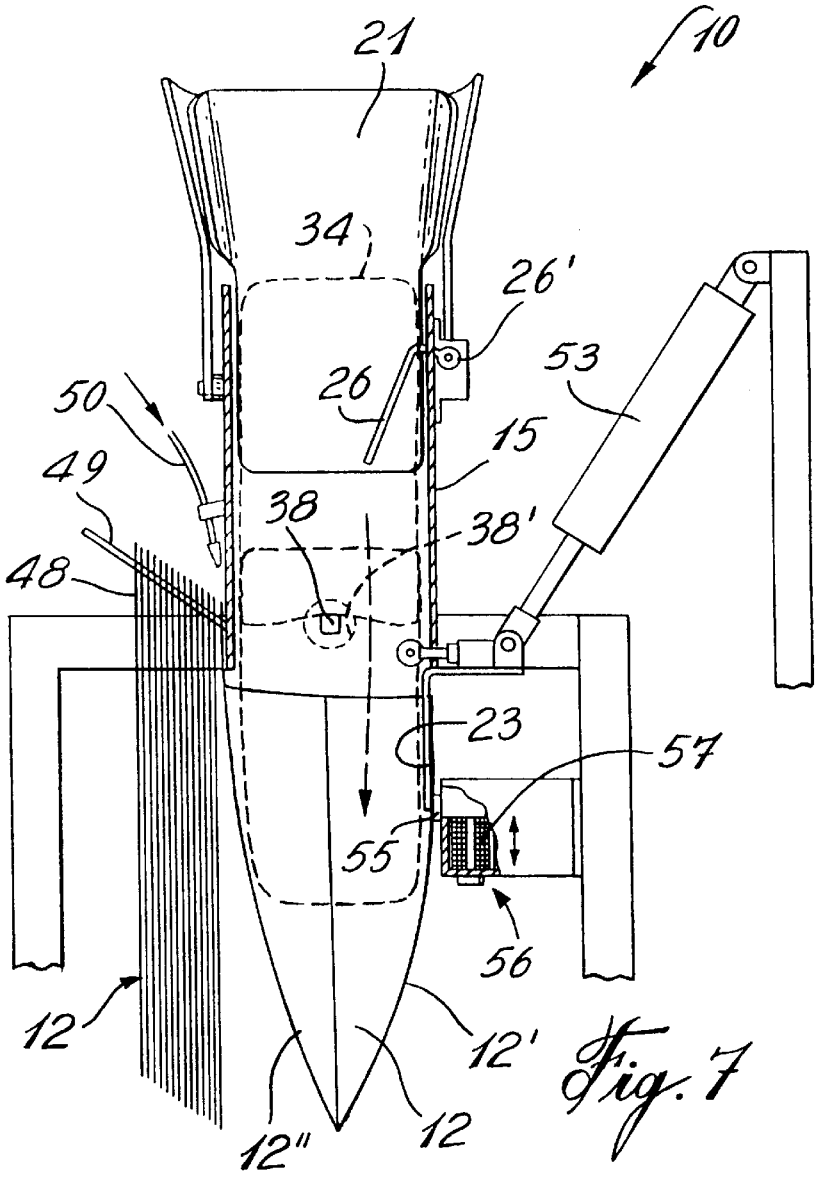
FIG. 7 is a view similar to FIG. 6 but showing the discharge gate positioned within the bag to hold the bag in an open position and simultaneously receiving articles within the bag.

Referring now to FIGS. 6, 7 and 8 there will be described the manner in which the pouches are loaded within the outer bag 12. As shown in FIG. 6, a plurality of juxtaposed bags 12 are retained on wicker pins 49 in a manner well known in the art by positioning a pair of holes (not shown) provided in the flaps 48 of the bags 12 onto the wicker pins 49. The bags are loaded with the outer wall 12' of each bag facing towards the bottom end 23 of the housing 15. A pair of air jet nozzles 50 are positioned in close proximity to the open end of the outermost one of the bags and provide a constant air stream in this area to cause the outer wall to separate from its rear wall 12" as shown in FIG. 6. This causes the mouth of a bag to open under the discharge gate 24.

As shown in FIG. 6, the discharge gate is an L-shaped gate having a pivotal link arm 51 secured to a pivotal mechanism 52 actuated by a piston 53. When the piston 53 is actuated by the control unit to open the gate 24, the gate enters the open mouth 54 of the foremost bag 12 and retracts the upper portion of the outer wall 12' against a bumper element 55 disposed thereunder whereby to clamp the upper end of the bag outer wall 12' between the discharge gate and the bumper. At the same time, the three pouches loaded in the housing are discharged within the outer bag. The weight of these pouches causes the flap 48 of the outermost bag to tear from the wicker pins 49 releasing the rear wall 12" of the bag. The bag is clamped before the pouches reach the bottom of the bag. In order to prevent the bag 12 from tearing upon release of the load of the three pouches therein, the bumper element 55 is secured on a shock absorbing mechanism 56 comprising a pair of springs 57, only one being shown in FIG. 7, permitting the clamped front wall 12' to move downwardly under the pulling force of the bag. Once the outer bag is loaded, the discharge gate 24 is retracted by the piston 53 to its initial position, as shown in FIG. 6, releasing the bag 12 onto the horizontal discharge conveyor 28, as shown in FIG. 8, wherein the outer bag and its three pouches is immediately conveyed away from the bagging machine 10.

Although, as above described, the finger support elements 38 and 39 were described as operating individually, they could also operate at the same time (see FIG. 8) for the reason that the opposed end compartment, to the one being loaded with a pouch after release of the discharge gate, does not contain any pouch therein. Accordingly, that finger support element would not hinder the operation of the machine.

Figure 10:
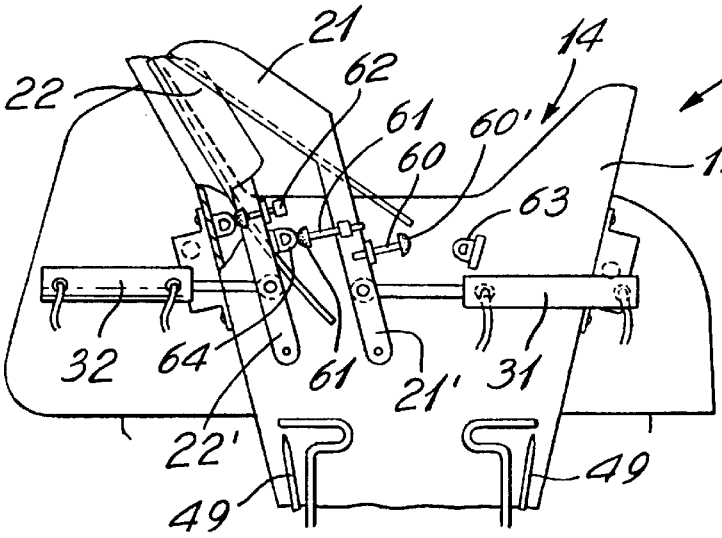
FIG. 10 is a simplified end view showing the hinge gate adjustment means as well as the bag holding means.

Referring now to FIG. 10, there is shown adjustment means in the form of threaded bolts 60, 61 and 62 secured to the hinge arms 21' and 22' of the hinge gates 21 and 22 respectively, whereby to adjust the position of these gates. The threaded bolts are provided with abutment heads 60', 61' and 62' to abut against a shock absorbing stopper element 63, 64 and 65 respectively. These sound absorbing elements are formed of rubber whereby to prevent metal contact and eliminate unnecessary noise and wear due to the actuation of the hinge gates. By threading or unthreading the bolts 60, 61 and 62 it can be seen that the positions of the gates are made adjustable. It can be appreciated that sequential operation of the gates results in reduced wear and tear and longer machine life.

It is within the ambit of the present invention to cover any obvious modifications of the preferred embodiment described herein, provided such modifications fall within the scope of the appended claims.

We claim:

1. An automatic article bagging machine for placing at least two articles in a bag from an article receiving housing having at least two compartments loaded in alternating sequences from an article feeding device carrying a plurality of spaced articles, said housing receiving said articles therein in an uninterrupted manner, said housing having a hinged gate to guide a first one of said articles from said article feeding device to a first one of said compartments when said hinged gate is in a guiding position, a further one of said articles being discharged in a further one of said compartments with said hinged gate moved to a non-obstructing open position with respect to said further one of said compartments, said housing having a discharge gate at a lower end thereof, bag support means for holding a bag under said compartments in a position to receive said at least two articles when said hinged gate is moved to a discharge open position, detection means to sense the presence of said first and second articles as they enter said first and further compartments, control means for receiving signals from said detection means, article support means displaceably movable in and out of a lower section of each of said compartments above said discharge gate and actuable by said control means to momentarily enter its associated compartment to support a succeeding article being discharged in at last loaded one of said compartments moments after said discharge gate is moved to said discharge position where said articles in said compartments are released from a bottom open end of said housing and with said hinged gate remaining in said non-obstructing open position to accept a first article of a next group of said at least two articles in said further one of said compartments.

2. An automatic article bagging machine as claimed in claim 1 wherein said housing is provided with three of said compartments, a central compartment being located between opposed end compartments, there being two of said hinged gates to direct said first and a second article to said first and said central compartment, said further compartment being a third one of said compartments, said further article being a third article, said article support means being associated with said first and third compartments which are said opposed end compartments.

3. An automatic article bagging machine as claimed in claim 2 wherein said detection means is a switch arm extending in each of said compartments through a wall of said housing and disposed in obstruction with the path of said articles discharged therein.

4. An automatic article bagging machine as claimed in claim 3 wherein said control means has a delay circuit associated therewith which is programmed to actuate said product support means a predetermined time delay after said switch arm is actuated by said third article entering said third compartment whereby said article support means will interfere with an open end of said third compartment when said discharge gate is open to support a fourth article discharged in said third compartment.

5. An automatic article bagging machine as claimed in claim 4 wherein said switch arm extending in said third compartment, when actuated by said fourth article, generates a signal which is sensed by said control means to actuate a second hinge gate to direct a fifth article in said central compartment and upon which said fifth article actuates said switch arm in said central compartment to generate a further signal which is sensed by said control means to actuate a first hinge gate to direct a sixth article in said first compartment which actuates said switch arm associated with said first compartment whereby said control circuit causes said discharge gate to release said three articles loaded in reverse sequence and consecutively in said three compartments; said control means, after said predetermined time delay, actuates said article support means of said first compartment to support a seventh consecutive article and again reverse the loading cycle in sequence.

6. An automatic article bagging machine as claimed in claim 5 wherein said articles are pouches containing a product therein.

7. An automatic article bagging machine as claimed in claim 6 wherein said pouches are milk bags.

8. An automatic article bagging machine as claimed in claim 2 wherein said article support means is a support element connected to a piston and actuable by said control means to move said support element into its associated one of said first or third compartment through a port in a side wall of said housing.

9. An automatic article bagging machine as claimed in claim 2 wherein said discharge gate is a hinge plate movable against said bottom open end of said housing and constituting a bottom wall of said housing when closed, a plurality of juxtaposed bags retained on wicker pins adjacent said bottom open end of said housing, means to cause a front wall of a foremost one of said juxtaposed bags to be displaced forwardly to open a mouth of said bag under said discharge gate; said hinge plate, when actuated to an open position, entering said open mouth of said bag and pulling said front wall to clamp same against a bumper element, said bag having a flap held by said wicker pins whereby said bag is supported on opposed sides, said articles when discharged in said open bag causing said flap to tear away from said wicker pins, said bag being released with said articles therein by displacing said hinge plate back to a closed position to close said open end of said housing.

10. An automatic article bagging machine as claimed in claim 9 wherein a discharge conveyor is supported a predetermined distance below said bag with said articles therein to displace said bag from under said housing.

11. An automatic article bagging machine as claimed in claim 9 wherein said bumper element is mounted on a spring mechanism to absorb shocks when said articles are discharged within said bag thereby preventing said bag from tearing.

12. An automatic article bagging machine as claimed in claim 2 wherein said hinged gates are secured to hinge arms each being actuable by piston cylinders, adjustment means secured to said arms to adjust the position of said gates, and sound damping means to prevent metal contact to eliminate noise when said hinge arms are displaced against said adjustment means.

13. A method of automatically bagging at least two articles in a bag from an article receiving housing having at least two compartments loaded in alternating sequences from an article feeding device carrying a plurality of spaced articles, said method comprising the steps of:

i) feeding by means of a hinge gate a first one of said articles in a first compartment of an article holding housing, ii) detecting said first article entering said first compartment, iii) displacing a first hinge gate to a non-obstruction open position with respect to a further compartment to accept a second article in said further compartment, iv) detecting said second article entering said further compartment, v) discharging said articles from a bottom end of said compartment through a hinged gate to release the articles into said bag, vi) actuating an article support means to enter said further compartment to obstruct an open bottom end of said further compartment a predetermined time delay after said step (v) to support a first article of a next group of articles being discharged in said further compartment while said hinged gate remains in said non-obstructing open position to accept said first article of said next group of said two articles.

14. A method as claimed in claim 13 wherein said housing is provided with three of said compartments a central compartment being located between opposed end compartments, there being two of said hinged gates to direct said first and a second article to said first and said central compartment, said further compartment being a third one of said compartments, said further article being a third article, said article support means being associated with said first and third compartments which are said opposed end compartments, there being further provided after step (iv) the steps of:

a) displacing a further hinge gate to guide said second article to said central compartment, b) detaching said second article entering said central compartment, c) displacing said further hinge gate in non-obstruction to said third compartment to receive a third article therein, said step (vi) comprising actuating said article support means to enter said third compartment.

15. A method as claimed in claim 14 wherein after step (v) and before step (vi) there is provided the step of actuating a time delay circuit before actuating said article support means.

16. A method as claimed in claim 14 wherein after step (v) there is provided the steps of:

vi) displacing said hinge plate in obstruction with said bottom end of said compartments, vii) retracting said article support means under a fourth article in said third compartment, viii) displacing said further hinge gate to receive a fifth article in said central compartment, ix) detecting said fifth article entering said central compartment, x) displacing said first hinge gate to receive a sixth article in said first compartment, xi) detecting said sixth article entering said first compartment, and xii) discharging said articles from a bottom end of said compartment through a hinge plate to release the articles in a further open end of a bag supported under said housing.

* * * * *